US006360666B1

(12) United States Patent
Harris

(10) Patent No.: US 6,360,666 B1
(45) Date of Patent: Mar. 26, 2002

(54) ALIGNMENT FIXTURE

(75) Inventor: Marlon D. Harris, Christiansburg, VA (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

(21) Appl. No.: 09/587,962

(22) Filed: Jun. 6, 2000

(51) Int. Cl.[7] ..... F42B 5/02; F42B 3/00; F42B 33/14

(52) U.S. Cl. ..... 102/430; 102/431; 102/530; 102/282; 102/700; 86/12; 86/47; 86/20.12

(58) Field of Search ..... 102/430, 431, 102/530, 282, 700; 86/20.12, 12, 17, 47, 1.1

(56) References Cited

U.S. PATENT DOCUMENTS

| | | | | | |
|---|---|---|---|---|---|
| 3,747,532 | A | * | 7/1973 | Berger | 102/700 X |
| 4,630,341 | A | * | 12/1986 | Rohmer et al. | 86/12 X |
| 4,702,167 | A | | 10/1987 | Reinelt et al. | 102/282 |
| 4,738,202 | A | * | 4/1988 | Hebert | 102/430 X |
| 4,864,932 | A | | 9/1989 | Reinelt et al. | 102/282 |
| 5,212,342 | A | | 5/1993 | Eches et al. | 102/317 |
| 5,218,166 | A | * | 6/1993 | Schumacher | 102/431 |
| 5,282,423 | A | | 2/1994 | Sikorski et al. | 102/431 |
| 5,454,323 | A | | 10/1995 | Conil | 102/282 |
| 5,481,978 | A | * | 1/1996 | Muller | 102/430 X |
| 5,563,365 | A | * | 10/1996 | Dineen et al. | 102/430 X |
| 5,672,842 | A | | 9/1997 | Brion et al. | 102/282 |
| 5,747,723 | A | | 5/1998 | Buckalew et al. | 102/282 |
| 5,844,163 | A | | 12/1998 | Lindskog | 89/46 |

FOREIGN PATENT DOCUMENTS

| | | | | |
|---|---|---|---|---|
| CH | 207559 | * | 9/1966 | 86/1.1 |
| DE | 3812644 | * | 4/1987 | 102/431 |
| GB | 2259753 | * | 9/1992 | 102/430 |
| JP | 5-105572 | * | 4/1993 | 102/430 |

* cited by examiner

*Primary Examiner*—Peter A. Nelson
(74) *Attorney, Agent, or Firm*—Nikolai & Mersereau, P.A.

(57) ABSTRACT

An apparatus for use in filling and capping artillery charge system modules or the like including a lower fixture carried by a base plate for receiving a module with an open center core tube and fixing the module in place relative to the base plate for filling and capping. An upper fixture is carried by a pivot plate for capping a filled module, the pivot plate being hingedly attached with respect to the lower fixture to enable the upper fixture to swing clear of the lower fixture during module loading and thereafter addressing a fixed module to cap same. The lower fixture further includes a centering rod that carries a peripherally disposed flexible expanding member and a shaped cam lock member which operate the expander member to receive, lock and unlock a center core tube to the centering rod to capture and fix the module in place. The cam lock member also aligns the system for lid insertion by an adjustable stroke air cylinder mounted on the pivot plate.

12 Claims, 5 Drawing Sheets

ALIGNMENT FIXTURE

BACKGROUND OF THE INVENTION

I. Field of the Invention

The present invention relates generally to propellant charge systems for large caliber artillery pieces, more particularly, to modular artillery charge systems or MACS, and involves improvements in a load, assembly and packaging process for manufacturing field modular charge units for singular and multi-unit propellant charge systems. Specifically, the invention is directed to an improved alignment fixture which fixes the relative positions of the case and core tube during the time the case is filled and further facilitates the lid to be guided into place and inserted with precision.

II. Related Art

Propellant charges for cannon artillery systems, primarily large caliber weapons systems such as 155 mm howitzers, etc., typically include plurality of coordinating modular charge units serially loaded behind the shell. The individual modular charge units are generally cylindrical in shape, frequently having a length to diameter ratio approaching 1. A central axial opening is provided through each unit to facilitate ignition of that and consecutive units. Such a system concept is illustrated, for example, by Reinelt, et al., in U.S. Pat. No. 4,702,167.

Particular embodiments of such modular units are of a three-piece design, which includes a combustible case body, normally of nitrocellulose, having a closed end and an open end, a combustible cap or lid adapted to fit or nest in and seal into the open end of the case body, and a perforated combustible central or core tube which fits over raised rims in the central bores of and connects the central openings provided in the closed ends of both the relatively rigid case body and lid to form a continuous central bore for containing core igniter bags. Top and bottom recesses are provided to accommodate two end igniter bags. This assures proper ignition of a number of serially placed modular charges. Up to eight modular charges may be employed in firing a 155 mm howitzer, for example.

The MACS load, assemble and pack process utilizes a series of discreet workstations, each of which is designed to accomplish a specific operation on the case, charge and additive materials. The present invention deals primarily with the provision of a significantly better approach to one difficult manual portion of the process including an operation at a loading station in which the case and core tube must be held in precise alignment during filling and during the operation in which the lid or cap is guided and inserted into place to seal the modular unit.

In the past, the operation has presented problems. No positive positioning devices existed and the central tube or core was placed over the rim or lip extension of the opening formed in the bottom of the case by hand and held in place while a weighed amount of propellant was poured about the tube to fill the case. Proper alignment was thus dependent on the repetitive skill of the operator. This had to be done while the assembly was vibrated to achieve proper propellant density. After the case was filled, the lip of a central opening in the cap or lid had to be fit over the central tube and the edge nested inside the case sidewall. Of course, if the central tube was not axially aligned so as to be concentric with the lid or cap and case, when the lid was fitted to the filled case and installed into the top of the case and over the top of the core tube, the core tube and lid could be easily damaged resulting in rejection of the module. This occurred often enough to be considered a severe defect in the process, one for which there was a definite need for a solution.

Accordingly, it is a primary object of the present invention to provide a system that automatically provides and maintains proper alignment among the case body core tube and lid during filling and capping assembly of a MACS charge.

It is a further object of the present invention to provide alignment an fixture that is capable of maintaining alignment of top and bottom protrusions utilized in lid/case body assembly in certain MACS charges, such as the XM 231 and XM 232 howitzer charges.

A further object of the present invention is to provide an alignment fixture that holds the case and lid in the specific orientation and utilizes a locking and expanding mandrill to center the core tube in position.

A yet still further object of the present invention is to provide an alignment fixture which holds the case and lid in a specific orientation utilizing a locking and expanding mandrill to center the core tube wherein the mandrill further acts as a guide for the lid as it is being inserted.

Another object of the present invention is to provide an alignment fixture which includes a holding fixture for the lid equipped with a device that inserts the lid in the case body to a controlled depth.

Still another object of the present invention is to provide an alignment fixture and system in which, once the case is loaded with propellant, the fixture is closed and the lid insertion is performed automatically.

An additional object of the present invention is to provide a mechanized processing station that includes an alignment fixture and lid insertion device that prevents core tube and/or lid damage during filling and capping assembly of modular units.

Additional objects and advantages regarding the fixture system of the invention will become apparent to those skilled in the art upon familiarization with the specification, drawings and claims associated with this specification.

SUMMARY OF THE INVENTION

The present invention provides solutions to several severe problems encountered in production of modular artillery charge system propellant units and specifically problems stemming from an inability to maintain proper alignment of the parts during manual loading and capping operations by the provision of a mechanized system including an alignment fixture which simplifies and improves the alignment of the case body and center case tube during loading and guides the lid into place during the lid insertion operation or capping step.

The alignment fixture is an assembly including a metal base member which may be machined aluminum base having a bottom and sidewall adapted to receive the lower portion (bottom and partial sidewall) of the modular unit case body of the MACS charge. The fixture base includes a central bore for receiving an elongated centering rod or spindle directed up through the center of the case body and carries a flexible peripheral member or expander which is expanded by a similarly shaped cam lock member which fits over the upper centering rod to positively position the upper portion of the center core tube or ignition tube. The cam lock portion of the mandrill is tapered at the upper end and also acts as a guide for the lid as it is being inserted. The cam lock member or mandrill operates vertically to lock and unlock the module core tube. The holding fixture for the lid is equipped with a fluid operated, preferably, an air cylinder of adjustable stroke that inserts the lid in the case body after the fixture is closed. The stroke depth of the cylinder is controlled with cam operated limit valves that may be adjusted to insert the lid to a specific depth in the case body. This device further aligns cap protrusions with case recesses in accordance with the desired orientation for insertion of the lid.

In operation, after the operator has placed the case body in the alignment fixture, the core tube is inserted over the raised cam lock member or mandrill and the lower end of the core tube is properly seated over the lower extension in the case body. The mandrill is lowered to expand the flexible peripheral member to fix the orientation of the upper portion of the core tube with respect to the alignment fixture. The alignment fixture is attached to a vibration table which is initiated while the operator loads the case with a preweighed amount of propellant thereby assuring proper propellant fill. After the propellant is loaded, the pivot plate is rotated to a latched position above and parallel to the base plate.

After that, the lid insertion is performed automatically by activation of the air cylinder and the vibration table is shut off at the end of the cycle.

BRIEF DESCRIPTION OF THE DRAWINGS

In the drawings, wherein like numerals depict like parts throughout the same.

DETAILED DESCRIPTION

Figure 1:
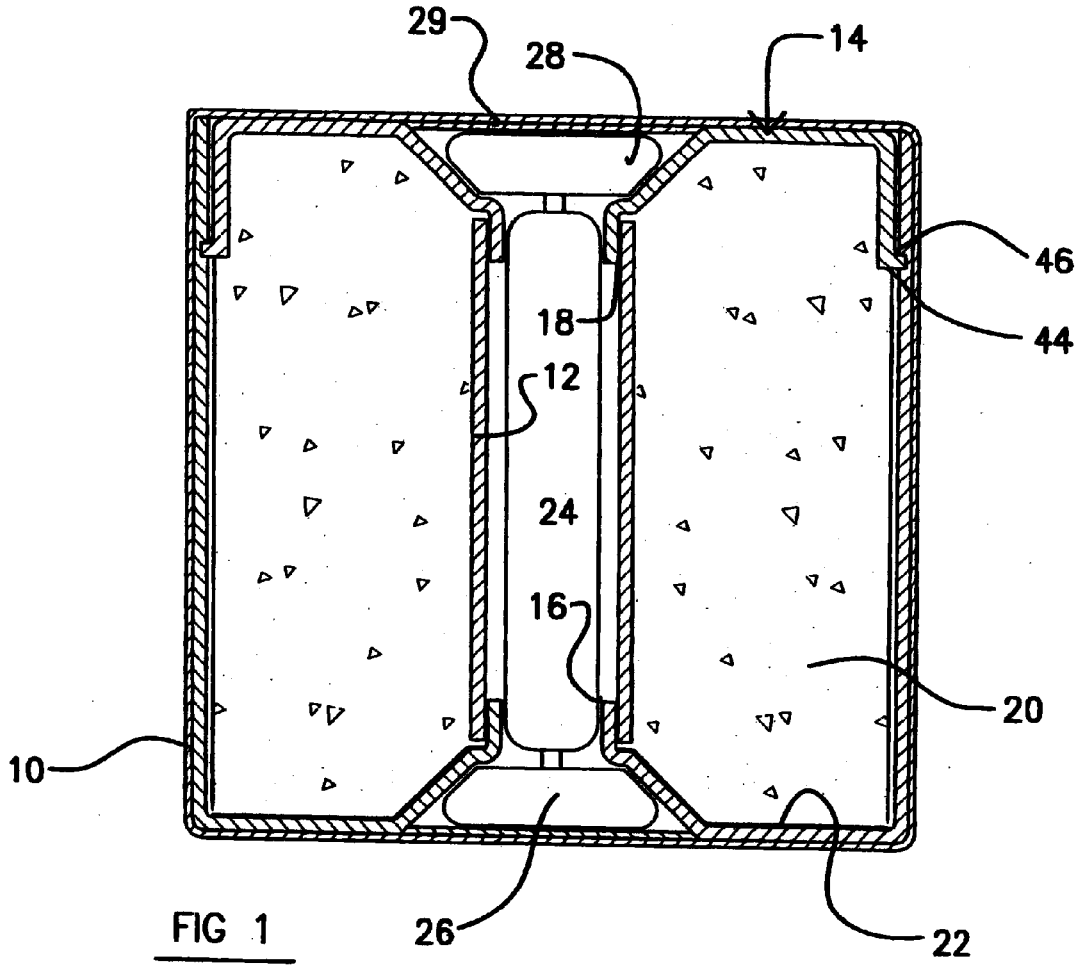
FIG. 1 is a cross section view of an individual propellant charge module of a class suitable to be manufactured using the fixture of the system of the invention.
Figure 2:
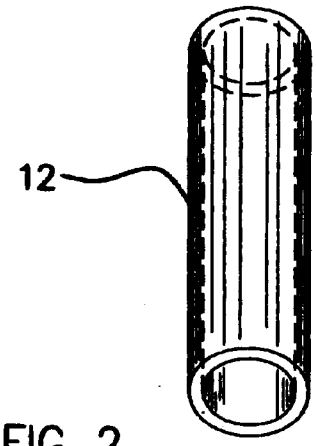
FIG. 2 is a perspective view of a center core tube in accordance with the charge module unit of FIG. 1.
Figure 3:
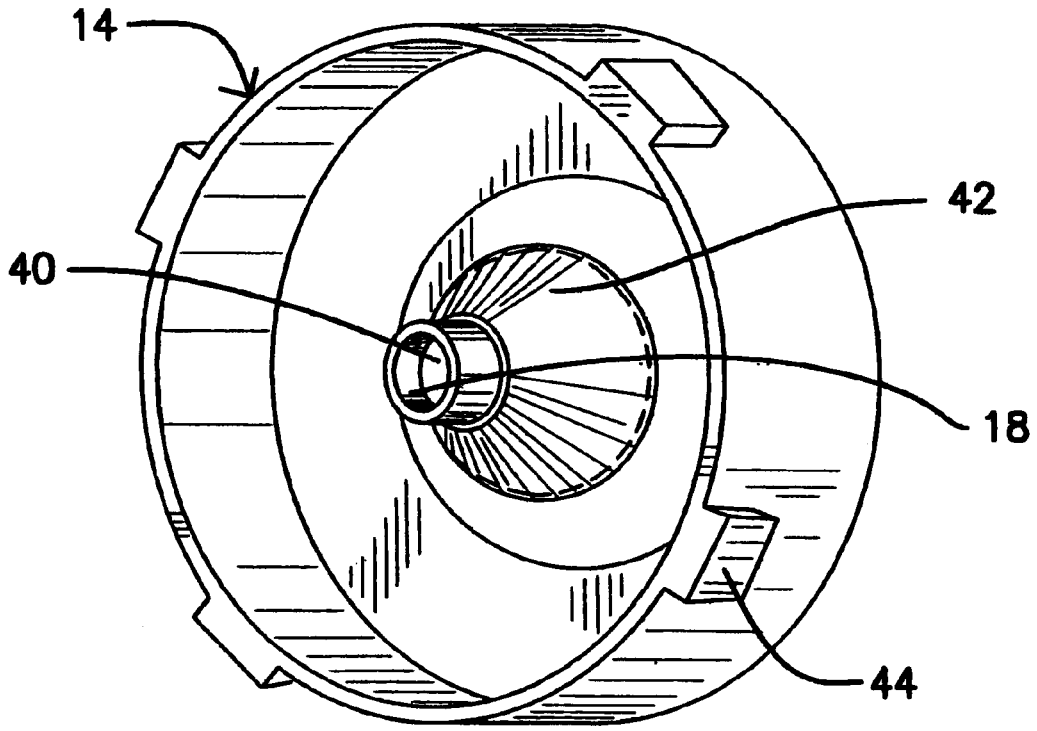
FIG. 3 is a perspective view of a lid for the modular unit of FIG. 1.

FIGS. 1–3 depict a typical modular artillery charge system (MACS) charge unit, usable alone or serially with various numbers of other units in a plurality of propellant-loading configurations as a propellant charge for large cannons such as the 155 mm howitzer. It will occur to those skilled in the art that the system and method associated with the present invention are usable for processing a variety of these types of charges and that the charge of the detailed description is meant as an example and not by way of limitation.

The modular charge unit and elements depicted in FIGS. 1–3 is included herein as an illustrative example of a charge unit which can be produced using the fixture system of the present invention. Additional details of such modular charge units are found in U.S. Pat. No. 5,747,723 issued to Gregory Buckalew et al., which is incorporated herein in its entirety by reference for any reason. The illustrated charge unit is intended as an example and not by way of limitation with respect to the present invention.

Thus, FIG. 1 shows a modular propellant charge unit including a unit body or shell 10, center core tube 12, and a cap 14 as the basic parts thereof. As can be seen from the figures, each of these is generally made up of a thin-walled hollow cylinder which, in the case of the center core tube 12, has two open ends. The body 10 and cap 14 each have an open end and a closed end. As seen in the figures, the open end of cap 14 fits into and seals the open end of the body 10 and the closed ends of both cap 14 and body 10 describe central openings with short tubular extensions. As further depicted in FIG. 1, the center core tube 12 is positioned longitudinally in the body 10 and receives tubular extension 16 defining the center open portion of the body 10 and tubular extension 18 defining the center open portion of the cap 14 at 18 in the assembled modular unit. The remaining portion of the body 10 is shown filled with a propellant material as at 20. The body, core and lid are generally made of combustible nitrocellulose coated with an environmentally stable protective coating shown about the periphery of FIG. 1 at 22. Typically, the body 10 and cap 14 each have a wall thickness between 2.0 mm and 2.7 mm. The dimensions and density of the body 10, core tube 12 and cap 14 must be within a very close tolerance to insure durability, critical functioning of the igniter and complete combustion. A core igniter bag 24 flanked by end igniter bags 26 and 28 is illustrated to make up the igniter system in FIG. 1. The make up and function of the igniter material is well known to those skilled in the art as is the composition of the main propellant charge and these details do not form a part of the present invention.

FIG. 2 depicts the center core tube or ignition tube 12 as a thin-walled cylinder with two open ends. The center core tube 12 typically has a wall thickness slightly less than that of the body 10 (typically 1.3–1.8 mm) may have a diameter of 17.7 mm to 31.8 mm. These dimensions are based on a 155 mm module and the devices have evolved and are designed in accordance with a large amount of accumulated interior ballistic knowledge or lore. As can be seen in FIG. 3, the central portion of the cap 14 continues the hollow-center core ignition system through an opening 40 and includes a conical recessed section 42 and a tubular extension or raised rim 18 which is designed to be accommodated in one end of the center core tube 12. The cap 14 further includes a series of protuberances or protrusions 44 disposed equally about the periphery of the open end of the cap and extending radially from the exterior surface. The protrusions 44 are designed to be accommodated or received in a groove 46 located in the body 10 (FIG. 1) so that the lid 14, when inserted, can be snapped into place. Once installed, a great deal of force is required to remove the lid from the modular body.

Figure 5:
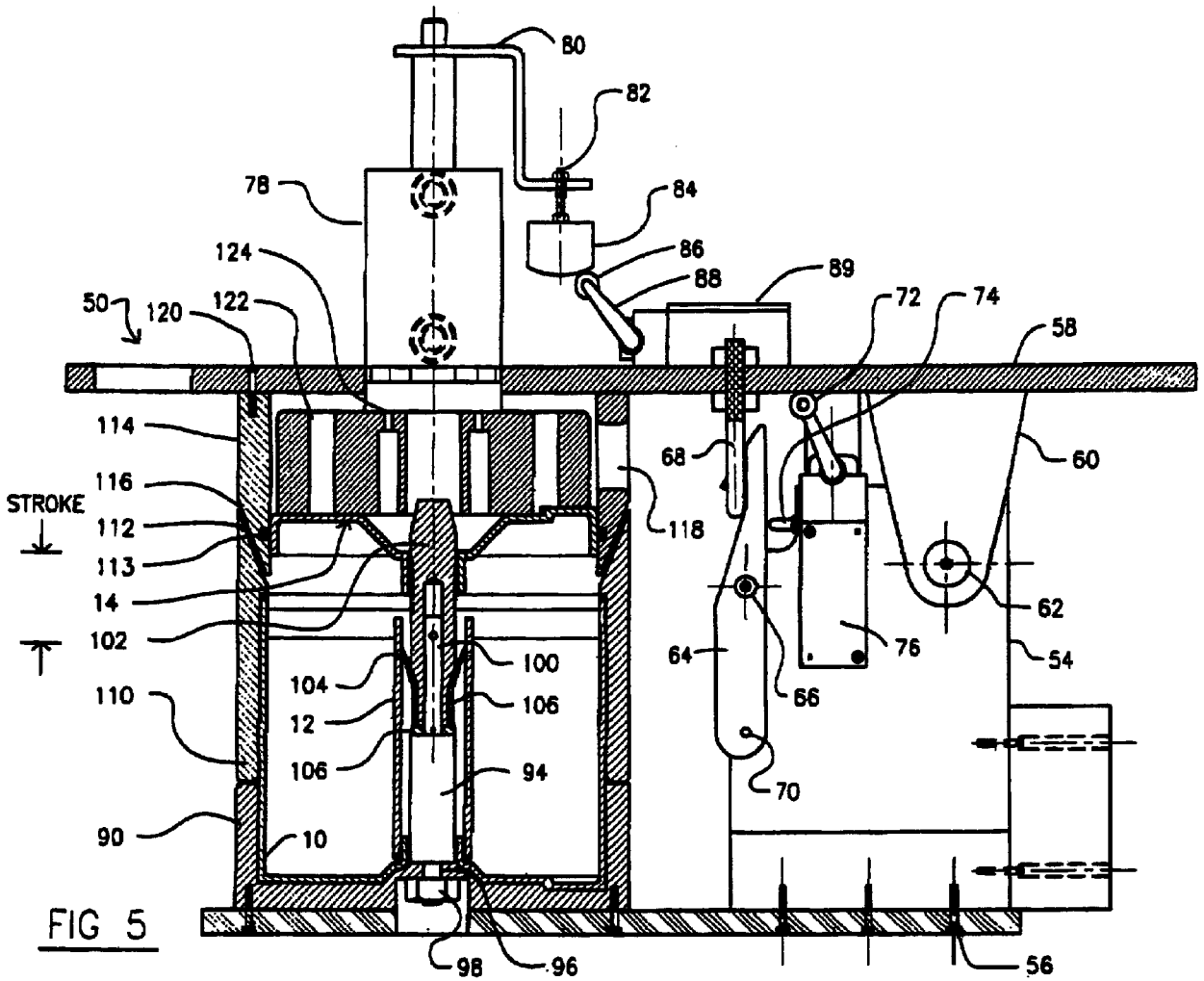
FIG. 5 is a side elevational view, partially in section of the alignment fixture of the invention.
Figure 6:
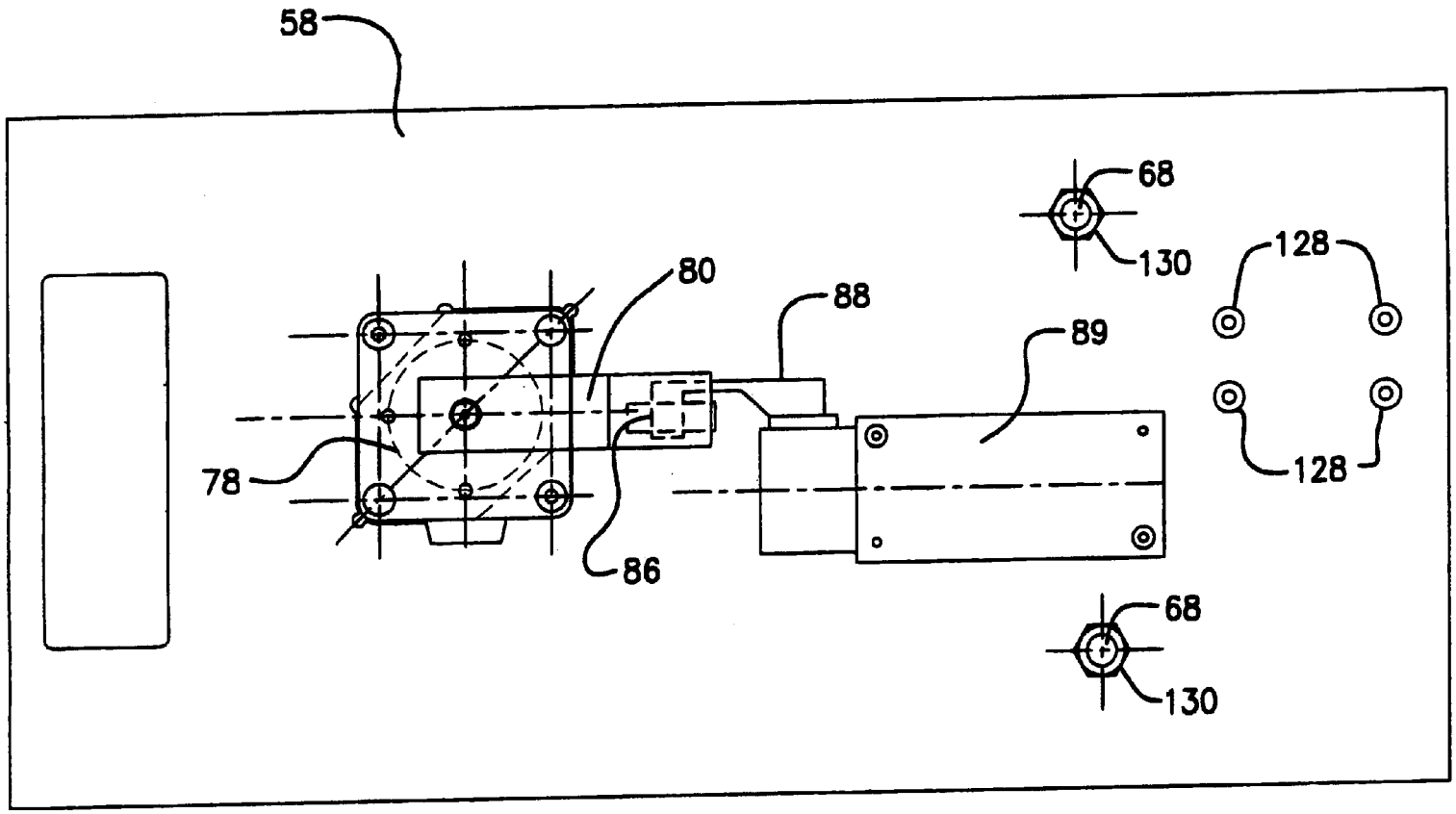
FIG. 6 is a top view of the alignment fixture of FIG. 5.

FIGS. 5 and 6 depict one embodiment of the filling and capping alignment fixture of the invention depicted generally by 50 and including a bottom or horizontal bed plate 52 to which the remainder of the assembly is fixed and which is designed to attach to a vibrating table. A pair of spaced support members, one of which is shown at 54, are fixed to the bed plate as by countersunk cap screws 56. These members of the assembly carry an upper or pivot plate 58 mounted on a pivot arm system 60 adapted to pivot relative to the members 58 on a pair of bushing and shoulder screw arrangements, one of which is illustrated at 62. The system also includes a pivot plate latching mechanism, including a pair of spaced latches, one of which is shown at 64 and which are pivotally mounted at 66, preferably also by a shoulder screw and bushing arrangement. A pair of strikers, one of which is shown at 68, are carried by the pivot plate 58 and a latch rod is illustrated at 70. A cam follower arm operated interlock switch 72 is provided with a spring plunger 74 in conjunction with a control valve shown at 76.

This arrangement accomplishes and verifies the latching of the pivot plate in the lowered position for the cap insertion step to be described.

An air cylinder assembly is also mounted on the pivot plate 58 and includes a fluid operated cylinder, which may be an air cylinder shown in the retracted position at 78. The cylinder is provided with a follower arm 80 which is connected as by a rubber bumper 82 to a cam member 84 which, in turn, operates a follower wheel 86 to pivot a connected switch arm 88 which, in turn, operates a valve 89. This system is adjustable to control the stroke of the air cylinder 78 in the capping operation.

The MACS body alignment module includes a case base receiving formed member 90 for receiving the bottom portion of the case of an initially unfilled propellant module as shown at 10. The base form has a central recess 92 containing a bore in which a centering rod or spindle 94 is mounted by means of a reduced diameter lower threaded portion 96 secured as by a hex nut 98. The centering rod 94 also has a reduced upper diameter at 100 which is adapted to receive the lower portion of a flexible core centering member 106 and the central bore of a similarly shaped vertically operating cam lock member 102. The shape of the lower portion of the cam lock member 102 is beveled at 104 to cooperate with the flexible peripheral member 106 to expand the upper portion of the peripheral member 106 to flare against and positively position a center core tube 12 when the cam lock member is in the fully inserted or lowered position and resting against the lower portion of the member 106.

Figure 4A:
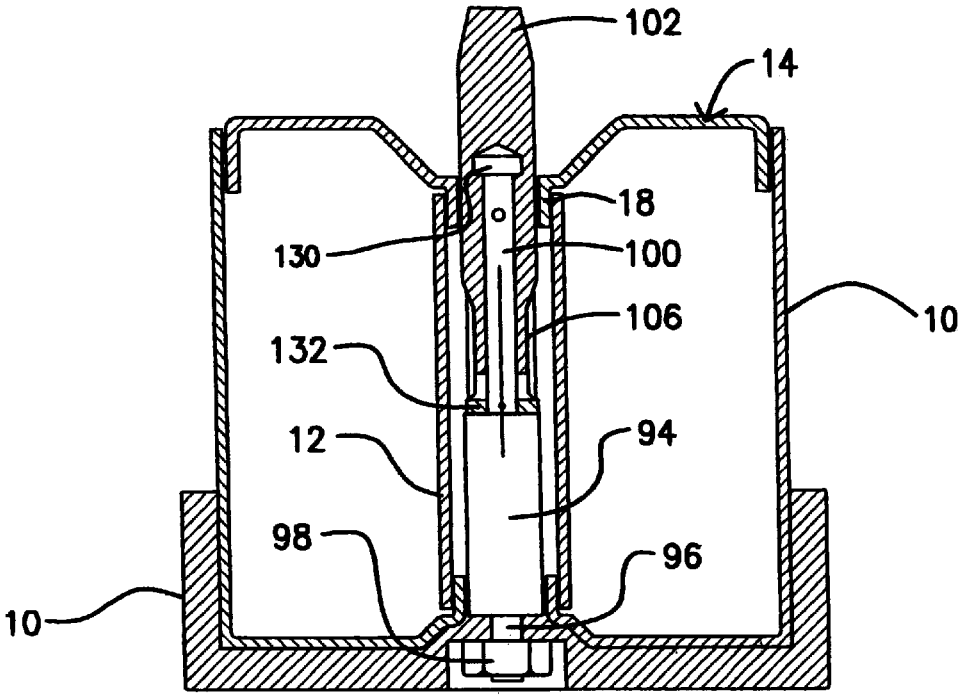
FIGS. 4*a* and 4*b* are views, partially in section, showing the holding and centering portion of the fixture of the invention in the unlocked and locked positions, respectively.
Figure 4B:
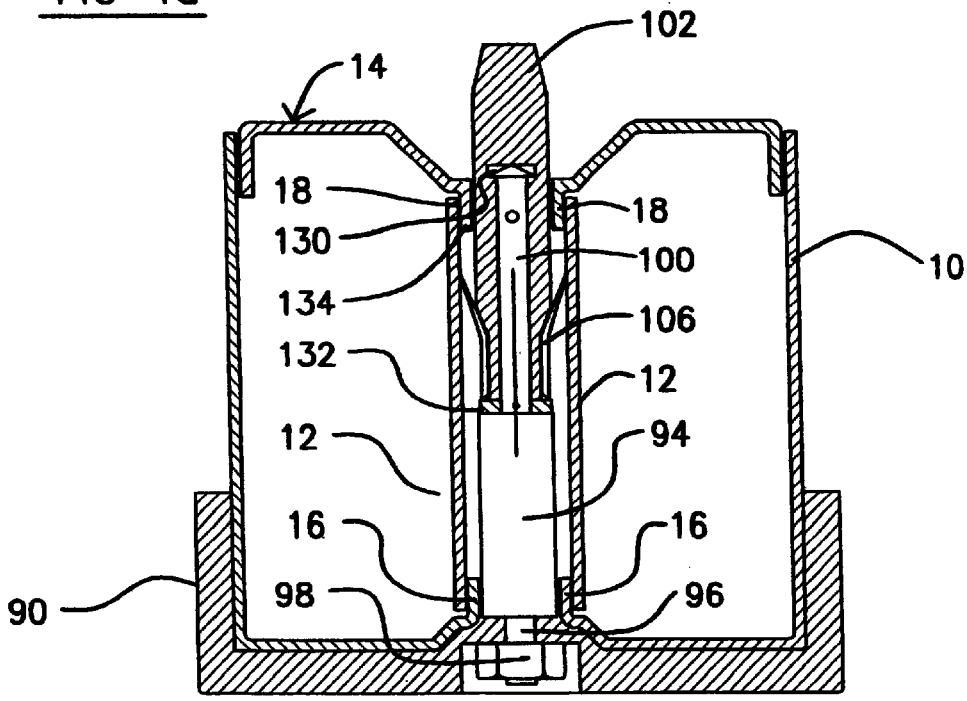

The system is illustrated in the unlocked position in FIGS. 4*a* and 5 and in the locked position in FIG. 4*b*. The alignment fixture for the base is shown enlarged in FIGS. 4*a* and 4*b*, respectively in the locked and unlocked positions to better illustrate the details.

The fixture also includes a cylindrical case mid-side guide surrounding the mid portion of the module case at 110 having a lower portion configured to match the module base receiving form 90 and is beveled inwardly at the upper end at 112 in a manner so as to cooperate with a matching cylindrical top case guide member 114 having a downward directed, outwardly beveled surface 116 which matches the surface 112 and to provide self-alignment includes a recess containing an O-ring at 117. The O-ring 117 retains a module lid or cap 14 in the upper case guide 114 prior to insertion by the stroke of a ram device 122 which has a bottom surface that matches the upper surface of the cap 14. Top case guide member 114 is further provided with a plurality of side vent openings, one of which is shown at 118 and is fixed to the pivot plate 58 by a plurality of threaded members, one of which is shown at 120.

The air cylinder 78 also carries a case ram device 122 fixed thereto as by threaded fasteners, one of which is shown at 124 and which is employed to push the cap 14 into place to seal the modular body 10 after loading. The length of the down stroke can be adjusted and is controlled by the follower arm and cam-operated control valve 89.

A side bumper is illustrated at 126 and screws, or the like, for fixing the pivot arm 60 to the pivot plate 58 are shown at 128 in FIG. 5. A pair of threaded fasteners, typically hex nuts 130, are shown in the top view of FIG. 5 for retaining the spaced strikers 68.

FIGS. 4*a* and 4*b* depict the mechanism for holding the modular case 10 with core tube 12 in a fixed, centered position for loading and capping. The figures are partially in section and show the device with the cap already in place and the side guide removed. Note that in the unlocked position of FIG. 4*a*, the cam lock member 102 is raised an amount and the peripheral flexible member 106 is in its relaxed and unflared position. Void spaces appear at 130 and 132. In FIG. 4*b*, the cam lock device is completely lowered, the beveled edges 104 expanding the flexible peripheral member 106 into contact with the intercore tube 12 in a manner which forces the tube 12 to be centered about the reduced upper diameter 100 of the centering rod 94. Not only does this fix the modular case 10 in place for loading, but it also defines the proper clearance about the upper portion of the cam lock member 102 at 134 to accommodate the central tubular extension 18 of the cap 14. This, together with the operation of the pivot plate of the alignment fixture, assures proper insertion of the cap 14 after completion of the loading operation.

In operation with the bed plate mounted on a vibrating table in a well known manner and, with the pivot plate pivoted upward and away from the MACS alignment module, a MACS case 10 is placed on the case base and a mid-side guide 110 is placed over the case base 90 and capturing case 10 with center core tube 12 in place, the cam lock member is lowered thereby centering the core tube 12. Energetic material is then added about the periphery of the center core tube filling the casing 10 with the desired weight of propellant of energetic propellant material. The energetic material may consist of any suitable main charge propellant pursuant to the particular modular charge being processed. This is done with the vibrating table operating so that the propellant granules are properly accommodated in the volume of the module. Once this is accomplished, a lid cap 14 is placed over the system and guided into a central location by the beveled edges 112 of the mid-side guide 110. Thereafter, the pivot plate may be pivoted into place and properly latched. This allows the valve 76 to enable the operation of the air cylinder 78 to operate the ram member 122 over the predetermined stroke distance to push the cap 14 into the top of the case 10 as guided by the guide member 114 and central locking cam member 102. In this manner, the fixture of the invention provides exact alignment among the center core tube, outer module case and inner and outer rims of the cap. Once the cap or lid member 14 is pushed the proper distance into place, the piston of the air cylinder 78 will retract pulling with it the ram member 122 and the pivot plate can thereafter be raised and the cam lock member unlocked so that the filled module can be removed from the fixture and another empty case placed for loading.

It will be appreciated that the elements of alignment fixture of the invention need to be of a conductive material so that any static electricity generated by the operation of the process is conducted away from the module being loaded and assembled. Thus, the bed and pivot plates are typically made of aluminum alloy and as is the base portion 90, the mid-case guide 110 and the ram 122 are typically of conductive polyethylene materials.

While the device of FIGS. 5 and 6 illustrates a fixture for processing an XM-232 MACS with very slight modifications in the ram and case base receiving member XM-231 MACS, one other module can be processed as well.

This invention has been described herein in considerable detail in order to comply with the Patent Statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. An apparatus for use in filling and capping artillery charge system modules or the like comprising:

(a) a lower fixture carried by a base plate for receiving a module having an open center core tube and fixing the said module in place relative to said base plate for filling and capping;

(b) an upper fixture carried by a pivot plate for capping a filled module, said pivot plate being hingedly attached with respect to said lower fixture to enable the upper fixture to swing clear of said lower fixture during module loading and thereafter to rotate into place for addressing a fixed module to cap same; and (c) wherein said lower fixture further comprises a centering rod that carries a peripherally disposed flexible expanding member and a shaped cam lock member which operates the expanding member to receive, lock and unlock a center core tube to the centering rod.

2. The apparatus of claim 1 further comprising a case base receiving member fixed to said base plate for receiving the bottom portion of an artillery charge system module case and carrying said centering rod in fixed relation thereto.

3. The apparatus of claim 1 wherein the cam lock member is provided with a vertically beveled surface that cooperates with the peripheral expander member to lock and unlock the center core tube in place as the cam lock member is lowered and raised along the centering rod.

4. The apparatus of claim 1 wherein said upper fixture further comprises a cylindrical upper case guide fixed to the pivot plate for carrying a lid for application to an artillery charge system module case and a fluid cylinder-operated ram for inserting the lid to seal the module case.

5. The apparatus of claim 4 wherein said upper case guide is provided with a recessed O-ring to retain said lid prior to insertion.

6. The apparatus of claim 4 further comprising a mid-side guide member for containing the mid portion of a module case and having an upper surface that self aligns with the lower surface of the upper case guide when the upper case guide is pivoted into place for capping.

7. The apparatus of claim 4 wherein said fluid cylinder is an air cylinder.

8. The apparatus of claim 7 further comprising a system for controlling and adjusting the stroke of the cylinder.

9. The apparatus of claim 4 further comprising interlock and latching means to assure that the pivot plate is latched parallel to the base plate prior to the operation of said fluid cylinder.

10. A method of filling and capping an artillery charge system module having an open center core tube comprising the steps of:

(a) providing an apparatus including:

(1) a lower fixture including a case base receiving member fixed to a base plate for receiving the lower portion of an artillery charge system module case and carrying a centering rod in fixed relation thereto, said centering rod carrying a peripherally disposed flexible expanding member and a shaped cam lock member which operates the expanding member to receive, lock and unlock a center core tube of a charge system module to the centering rod;

(2) an upper fixture carried by a pivot plate for capping a filled module, said pivot plate being hingedly attached with respect to said lower fixture to enable the upper fixture to swing clear of said lower fixture during module loading and thereafter rotate into place for addressing a filled fixed module, said upper fixture further comprising a cylindrical device fixed to the pivot plate for carrying a lid for application to an artillery charge system module case and a fluid cylinder-operated ram for inserting the lid to seal the module case and interlocked and latching means to require that the pivot plate is latched above and parallel to the base plate prior to the operation of said fluid cylinder;

(b) placing an artillery charge system module case in said case base, the center core tube over said cam lock member and adding a mid-side guide over said case base;

(c) locking said center core tube to said centering rod;

(d) filling said case with a pre-weighed amount of propellant;

(e) latching the pivot plate above and parallel to the base plate;

(f) operating said fluid cylinder to insert said lid into said case; and (g) unlatching and pivoting said pivot plate and removing said filled, capped modular case.

11. The method of claim 10 further comprising the step of filling said case while vibrating the system.

12. The method of claim 10 further comprising the step for adjusting the stroke of the cylinder as needed to assure proper cap insertion.

* * * * *